United States Patent [19]

Tsuji

[11] Patent Number: 4,505,360

[45] Date of Patent: Mar. 19, 1985

[54] ELEVATOR OPERATING SYSTEM

[75] Inventor: Shintaro Tsuji, Nagoya, Japan

[73] Assignee: Mitsubishi Denki Kabushiki Kaisha, Tokyo, Japan

[21] Appl. No.: 472,472

[22] Filed: Mar. 7, 1983

[30] Foreign Application Priority Data

Mar. 16, 1982 [JP] Japan ..... 57-41086

[51] Int. Cl.[3] ..... B66B 5/02; B66B 13/22

[52] U.S. Cl. ..... 187/29 R

[58] Field of Search ..... 187/29, 29 R, 31, 52, 187/52 R, 43, 47, 48; 364/424, 550

[56] References Cited

U.S. PATENT DOCUMENTS

| | | | |
|---|---|---|---|
| 3,814,214 | 6/1974 | Booker, Jr. | 187/29 R |
| 4,108,281 | 8/1978 | Glaser | 187/29 R |
| 4,326,606 | 4/1982 | Kuzunuki et al. | 187/29 R |
| 4,367,810 | 1/1983 | Doane et al. | 187/29 R |

FOREIGN PATENT DOCUMENTS

| | | | |
|---|---|---|---|
| 53-107050 | 9/1978 | Japan . | |
| 54-97948 | 8/1979 | Japan . | |
| 2110487 | 6/1983 | Japan | 187/29 R |

*Primary Examiner*—J. V. Truhe
*Assistant Examiner*—Paul Shik Luen Ip
*Attorney, Agent, or Firm*—Wenderoth, Lind & Ponack

[57] ABSTRACT

An elevator operating system includes an abnormality detector for detecting an abnormal door opening of an elevator car, a response limiting circuit which is responsive to the detection of the abnormal door opening to limit the response to car calls and floor calls for the elevator car, a re-execution circuit for re-executing the door opening of the elevator car detected as being abnormal, and a releasing circuit for releasing the limitation of the response to the car and floor calls in response to no detection of the abnormal door opening during its re-execution.

19 Claims, 5 Drawing Figures

ELEVATOR OPERATING SYSTEM

BACKGROUND OF THE INVENTION

This invention relates to improvements in an elevator operating system.

Elevator operating systems have the function of responding to the detection of an abnormality occurring in the operation of the elevator car to automatically take an emergency expedient. For example, after a command door-opening signal has been issued, the door of the elevator car is normally opened within a time interval of from two to three seconds. At that time, even though, for example, eight second has elapsed, the door may not open beyond a predetermined width. This is determined to be a door opening disablement and the elevator car is caused to automatically travel to the next succeeding floor whereby a passenger or passengers is or are prevented from being confined in the elevator car. Then, when the door opening disablement is again detected, even at the next succeeding floor, the elevator car is put out of service, which is signaled to the operator by the illumination of a fault lamp. Then, the passenger or passengers confined in the elevator car is or are to be urgently rescued from the elevator car.

However, where the door has been able to open at the next succeeding floor, the elevator car is not put out of service and calls continue to be effected in normal service. Thus, at that floor where the door opening has been determined to be disabled, the elevator car may again repeat a similar abnormal operation with a high possibility that, each time the abnormal operation is performed, the passenger or passengers become uneasy and alternatively, a deterioration of service is caused.

Also, the door may open at the end of six seconds after a command door opening signal has been issued. Although such a door opening operation is clearly different from the normal door opening operation, any countermeasure may not be taken without detecting the door opening disablement. This causes a high possibility of repeating the similar abnormal operation resulting in the occurrence of objections that time is spent until the door opens, thereby causing the passenger or the passengers to be irritable or uneasy.

In addition, the abnormal operations of the elevator car involve the departure disablement, the door closing disablement, etc. The term "departure disablement" means that the elevator car does not depart after the lapse of a specified time interval reckoned from the issuance of a command departure and the term "door closing disablement" means that a car door can not be closed after the lapse of a specified time interval reckoned from the issuance of a command floor closing signal. Those abnormal operations cause objections similar to those resulting from the door opening disablement.

In order to eliminate the latter objections, there have been already proposed the following countermeasures (a) Upon the occurrence of not less than a specified number of abnormal elevator operations within a predetermined time interval, which operations are returned back to the normal elevator operation before an automatic energency operation is performed, elevator car is put out of the service so as to not be responsive to calls occurring after that time.

(b) Upon detecting an abormal elevator operation at a floor, the response to calls for that floor is limited.

However, abnormalities of the operation of the elevator car may include temporary abnormalities resulting from passenger mischief, a floor doorsill getting clogged by dirt and so on. Upon detecting such a temporary abnormality, calls are permitted to be returned back to the normal service only after the operator or the like has inspected the temporary abnormality and removed its cause. This results in new objections that service to passengers is correspondingly deteriorated and the operator or the like is forced to spend his or her labor.

Accordingly, it is an object of the present invention to provide a new and improved elevator operating system arranged to be automatically returned back to the normal operation after the detection of an abnormality of the elevator operation when the detected abnormality is determined to have resulted from a temporary cause.

SUMMARY OF THE INVENTION

The present invention provides an elevator operating system responsive to the detection of an abnormality of the operation of an elevator car to take an emergency measure which system comprises, an elevator car, an abnormality detector means for detecting an abnormality of the operation of the elevator car and for generating a signal indicating the detected abnormality; and a call register means for registering car calls due to the operation of destination pushbuttons disposed on the elevator car and floor calls due to the operation of floor pushbuttons and for releasing the registration of the car and floor calls; the call register means including response limiting means responsive to the abnormality indicating signal from the abnormality detector means to limit the response to at least one of the car calls and floor calls, a re-execution means responsive to the elevator car being put out of service so as to generate a command re-execution signal for re-executing the operation identical to that detected as including the abnormality, and a releasing means for releasing the limitation of the response by the re-execution means when the abnormality detector means does not detect the abnormality included in the operation performed with the command re-execution signal.

In a preferred embodiment of the present invention, the abnormality detector means may include a timer for counting a time interval for which a selected one of the door opening, door closing and departure operations of the elevator car is fully performed so as to generate a counted time interval, a first comparator for comparing the counted time interval so as with a first reference time interval to produce an abnormality indicating signal in response to the counted time interval being not shorter than the first reference time interval, and a second comparator for comparing the counted time interval with a second reference time interval shorter than the first reference time interval so as to produce an abnormality indicating signal in response to the counted time interval being not shorter than the second reference time interval.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
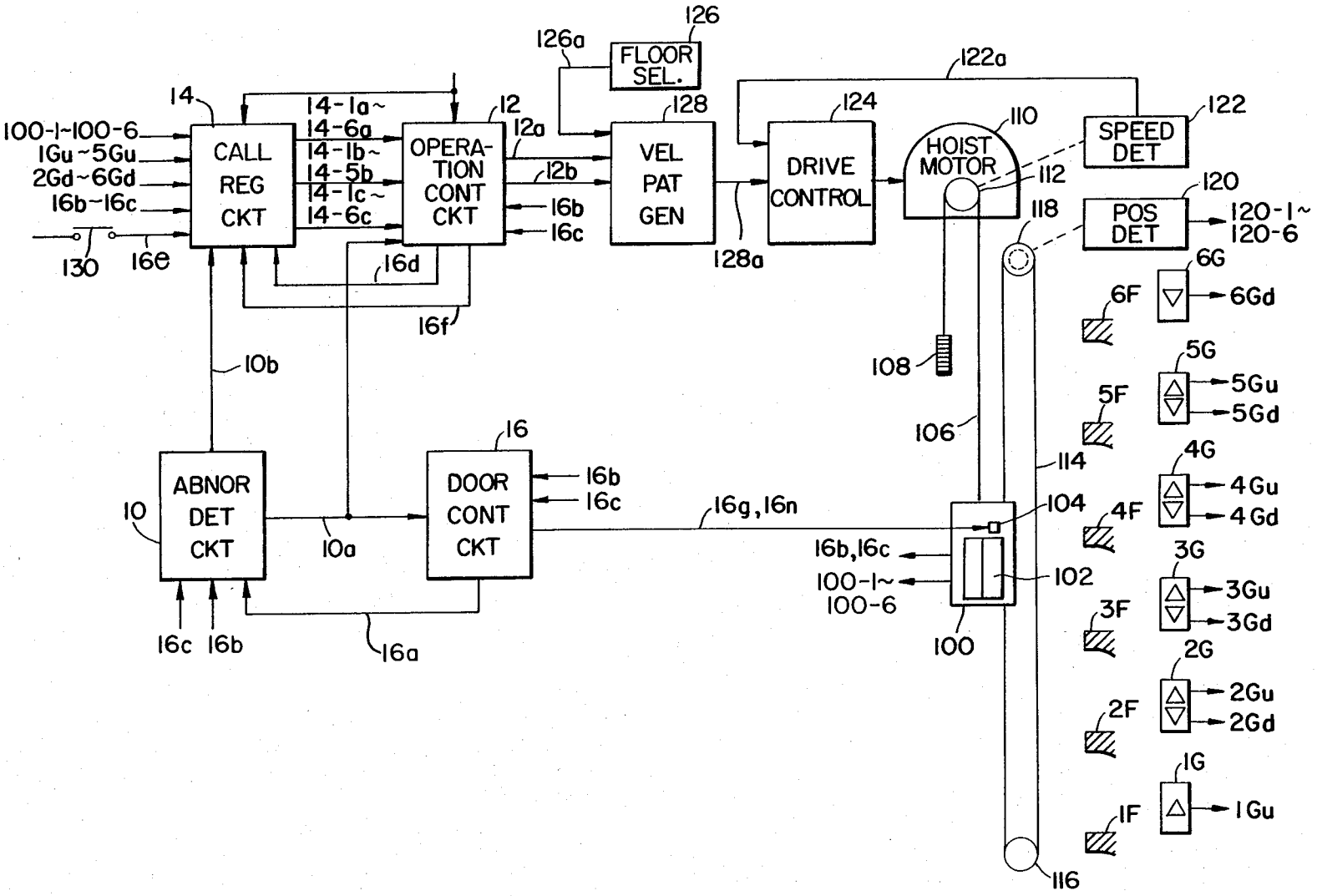
FIG. 1 is a block diagram of one embodiment according to the elevator operating system of the present invention.

Referring now to FIG. 1 of the drawings, there is illustrated one embodiment according to the elevator operating system of the present invention. For a better understanding of the present invention, the description will now be made in conjunction with an elevator system as shown in the righthand portion in FIG. 1, the operation of which is controlled by the present invention. The elevator system is shown as serving a building including six floors designated by 1F, 2F, . . . , 6F starting with the lowermost floor 1F and comprises an elevator car 100 including a car door 102 and an electric door motor 104, a hoisting rope 106 connected at one end to the elevator car 100 and at the other end to a counterweight 108, a hoist motor 110, a sheave 112 connected to the hoist motor 110 and having the hoisting rope 106 trained thereover, and an endless rope 114 connected at both ends to the elevator car 100 and spanned between a tensioning wheel 116 disposed at the lower end of a hoistway (not shown) and a rotary disc 118 disposed in a machine room (not shown) located above the upper end of the hoistway. The disc 118 has a plurality of small holes disposed at predetermined equal angular intervals on the peripheral portion thereof. A position detector 120 of a conventional structure is disposed to detect the small holes on the disc 118 rotated in synchronism with the travel of the elevator car 100 through the endless rope 114 so as to generate pulses, one pulse being generated for each of the small holes. The position detector 120 also adds the pulses during the up travel of the elevator car 100 and subtracts them during the down travel of the car so as to count the actual position of the elevator car 100 whereby the detector 120 selectively delivers car position signals 120-1, 120-2, . . . , 120-6, corresponding to the actual positions of the elevator car 100 on the floors 1F through 6F respectively.

Then, an up pushbutton 1G is disposed on a platform of the first floor 1F while a down pushbutton 6G is disposed on a platform of the sixth floor 6G. Also an up and a down pushbutton 2G, 3G, 4G or 5G are provided on a platform of each of the floors 2F, 3F, 4F or 5F. When depressed, the up pushbutton generates an up pushbutton signal at its high level H and the down pushbutton generates a down pushbutton signal at its high level H. 1G*u*, 2G*u*, 3G*u*, 4G*u* and 5G*u* designate the up pushbutton signals from pushbutton G1, G2, G3, G4 and G5 respectively and 2G*d*, 3G*d*, 4G*d*, 5G*d* and 6G*d* designate the down pushbutton signals from the pushbuttons G2, G3, G4, G5 and G6 respectively.

Furthermore, a speed detector 122 in the form of a tachometer generator which is well known in the art is mechanically connected to the sheave 112 so as to detect the actual speed of the elevator car 100 and to deliver an actual speed signal **122*a* to a drive control 124 of the conventional structure connected to the hoist motor 110**.

Also, a floor selector 126 having a well known configuration is provided to determine that predetermined floor on which the elevator car 100 is to be stopped and to deliver a stoppage predetermined floor signal **126*a* to a velocity pattern generator 128 which is well known in the art. The velocity pattern generator 128 is responsive to a command travel signal 12*a* or 12*b* at its high level H as will be described and which is later supplied thereto so as to deliver a velocity pattern signal 128*a* to the drive control 124. The drive control 124 is operative to compare the velocity pattern signal 128*a* with the actual car speed signal 122*a* so as to control the operation of the hoist motor 110 so as to render a difference between the velocity pattern signal 128*a* and the actual speed signal 122*a* equal to zero. The velocity pattern signal 128*a*** is one of an acceleration pattern signal, a constant velocity pattern signal and a deceleration pattern signal.

All the components as described above are well known in the art and the details thereof need not be described here.

In order to control the operation of the elevator car 100, the arrangement of FIG. 1 comprises an abnormality detector circuit 10, an operation control circuit 12 connected to the abnormality detector circuit 10, a call register circuit 14 connected to the abnormality detector circuit 10 and also connected in two ways to the operation control circuit 12 and a door control circuit 16 connected in two ways to the abnormality detector circuit 10 and also connected to the door motor 104 on the elevator car 100.

The abnormality detector circuit 10 is operative to detect abnormalities of the elevator operation and to be responsive to the detection of the door opening disablement to deliver a door opening disablement signal **10*a* at its high level H to the door control circuit 16 and is responsive to the detection of an abnormal door opening to deliver an abnormal door opening signal 10*b* at its high level H to the call register circuit 14**.

The operation control circuit 12 is operative to control the operation of the elevator car 100 such as a departure, a travel, the determination of a stoppage etc. in order to cause the elevator car to respond to a calls. For example, when the elevator car 100 is caused travel in the up direction, the operation control circuit 12 delivers a command up travel signal **12*a* at its high level H to the velocity pattern generator 128 and when the elevator car is caused to travel in the down direction the circuit delivers a command down travel signal 12*b* at its high level H to the velocity pattern generator 128. Also, the operation control circuit 12 delivers an on-stoppage signal 16*d* and a direction setting signal 16*f* to the call register circuit 14. The on-stoppage signal 14*d* is at its low level L during the travel of the elevator car 100 and at its high level H during the stoppage of the elevator car 100. The direction setting signal 14*f* is at its high level H when the elevator car 100** is set to travel in the up or down direction.

The operation control circuit 12 is described, for example, in Japanese laid-open patent application No. 107,050/1978 with reference to FIG. 1 and the pertinent portion thereof is incorporated into the present specification by reference.

The call register circuit 14 is operative to register and release car calls due to a plurality of destination pushbuttons (not shown) disposed in the elevator car 100 and floor calls due to the floor pushbuttons 1G through 6G. The call register circuit 14 is responsive to calls registered thereon to deliver associated call signals to the operation control circuit 12. More specifically, when the call register circuit 14 receives car call signals 100-1 through 100-6 for the first through sixth floors from the destination pushbuttons within the elevator car to register associated car calls for those floors, the circuit delivers to the operation control circuit 12 associated car call signals 14-1*a* through 14-6*a* at their high level H. When up calls for the first through fifth floors are registered due to the up pushbutton signals 1G*u* through 5G*u* resulting from the up pushbuttons 1G through 5G, up call signals 14-1*b* through 14-5*b* at their high level H are delivered to the operation control circuit 12. Similarly down call signals 14-2*c* through 14-6*c* at their high level H are delivered to the operation control circuit 12 in response to the registration of down calls at the second through sixth floors.

The door control circuit 16 is operative to control the opening and closing of the elevator door 102. The door control circuit 16 delivers to the abnormality detector circuit 10 a command door opening/closure signal 16*a* put at its high level H when the car door 102 is closed and at its low level L when the door 102 is opened. The circuit 16 receives a door opening switch signal 16*b* put at its high level H from the elevator car 100 when the door 102 has opened beyond a predetermined width and a door closing switch signal 16*c* put at its high level H from the elevator car 100 when the door 102 has fully closed. Those two signals are also applied to both the abnormality detector circuit 10 and the operation control circuit 12. Furthermore, the door control circuit 16 selectively supplies a command door opening signal 16*g* and a command door closing signal 16*h* to the door motor 104. The command door opening signal 16*g* put at its high level H is operative to drive the door motor 104 in a direction to open the door 102 while the command door closing signal 16*h* put at its high level H is operative to drive the door motor 104 in a direction to close the door 102.

In FIG. 1, a resetting signal 16*e* is shown as being applied to the call register circuit 14. The resetting signal 16*e* is put at its high level H when a resetting switch 130 disposed on a control board (not shown) is depressed to reset a re-execution diablement signal as will be described later.

The door control circuit 16 is described, for example, in Japanese laid-open patent application No. 107,050/1978 in conjunction with FIG. 1 and the pertinent portion thereof is incorporated into the present specification by reference.

Figure 2:
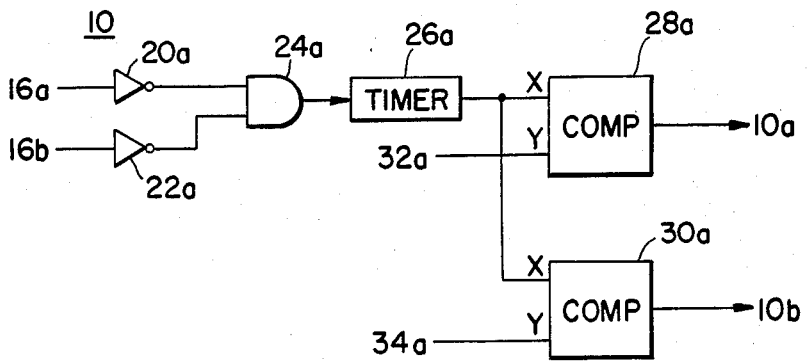
FIG. 2 is a block diagram of the abnormality detector circuit shown in FIG. 1.

FIG. 2 shows the details of the abnormality detector circuit 10. The arrangement illustrated is operative to detect the abnormal door opening and comprises a pair of NOT gates 20*a* and 22*a* having respective inputs receiving the command door opening signal 16*a* and the door opening switch signal 16*b* respectively and outputs connected to a pair of inputs to an AND gate 24*a* subsequently connected at the output to a timer 26*a*, and a pair of comparators 28*a* and 30*a* having respective inputs X connected to the output of the timer 26*a*. Each of the comparators 28*a* or 30*a* includes another input Y receiving a first constant magnitude signal 32*a* having a first reference duration, in this case equal to eight seconds, for the purpose of detecting the door opening disablement or a second constant magnitude signal 34*a* having a second reference duration, in this case equal to an interval which is shorter than the first reference duration, in this case equal to four seconds, for the purpose of detecting an abnormal door opening.

The timer 26*a* is operative to count a time interval for which the output from the AND gate 24*a* is at its high level H to deliver an output to the inputs X to the comparators 28*a* and 30*a* and to deliver a zero output to the inputs X to the comparators 28*a* and 30*a* in response to the output from the AND gate 26*a* put at its low level L. When the output from the timer 26*a* applied to the input X is equal to or greater than the constant magnitude signal 32*a* or 34*a* applied to the input Y, the comparators 28*a* or 30*a* can produe the door opening disablement signal 10*a* at its high level H or the abnormal door opening signal 10*b* at its high level H respectively. Otherwise, the comparators 28*a* and 30*a* produce the door opening disablement signal 10*a* and the abnormal door opening signal 10*b* at their low level L respectively.

Figure 3:
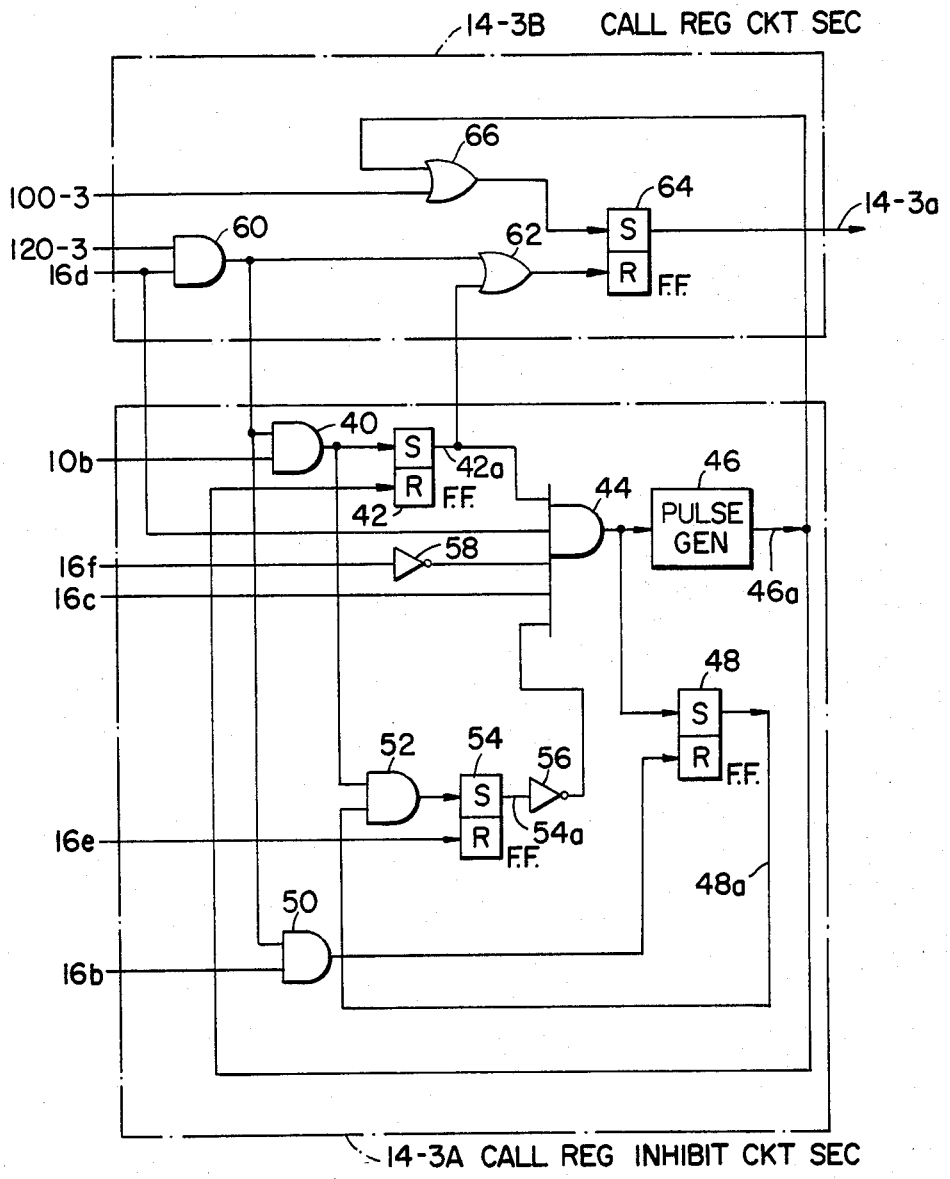
FIG. 3 is a circuit diagram of the call register shown in FIG. 1 and formed of logic elements for a floor of a building served by the elevator operation system.

FIG. 3 shows in the logic form the call register circuit 14 for the third floor. The illustrated arrangement comprises a call registration inhibiting circuit section generally designated by the reference numeral 14-3A and a call register circuit section generally designated by the reference numeral 14-3B. The call registration inhibiting circuit section 14-3A is operative with calls for the door opening signal because the comparator 30*a* determines that the output at its high level H from the timer 26*a* is equal in duration to the second constant magnitude signal 34*a*. If the output at its high level H from the timer is equal in duration to or greater than the first constant magnitude signal 32*a* applied to the comparator 28*a* then the comparator 28*a* produces the door opening disablement signal 10*a* at its high level H. The abnormal door opening signal 10*b* at its high level H causes the output from the AND gate 40 (see FIG. 3) to be put at its high level H. Thus, the third floor comprises an AND gate 40 having one input receiving the abnormal door opening signal 10*b* and an output connected to a setting input of an S-R FLIP-FLOP 42 which is called hereinafter a memory and arranged to deliver a call registration inhibiting signal 42*a* for the third floor to a first one of five inputs of an AND gate 44. The AND gate 44 has an output connected to a pulse generator 46 and a setting input of an S-R FLIP-FLOP or a memory 48. The pulse generator 46 generates a pulse signal 46*a* put at its high level H for about 0.5 second when the output from the AND gate 44 rises to its high level H from its low level. The pulse signal 46*a* is applied to a resetting input of the memory 42. The memory 48 is arranged to generate a signal 48*a* indicating that the door opening operation on the third floor is being re-executed which signal is called hereinafter an on-re-operation signal.

An AND gate 50 has one input receiving the door opening switch signal 16*b* and another input connected to the other input of the AND gate 40 and an output connected to a resetting input of the memory 48.

Also, AND gate 52 has one input connected to the output of the memory 48 and another input connected to the output of the AND gate 40 and an output connected to a setting input of an S-R FLIP-FLOP or a memory 54. The memory 54 has a resetting input supplied with the resetting signal 16*e* and delivers to an input of a NOT gate 56 a re-execution disablement signal 54*a* for disabling re-execution of the door opening operation.

The AND gate 44 includes further has a second input supplied with the on-stoppage signal 16*d*, a third input supplied with the direction setting signal 16*f* through a NOT gate 58, a fourth input applied with the door closing switch signal 16*c* and a fifth input connected to the output of the NOT gate 56.

The call register circuit section 14-3B is also operative with calls for the third floor and comprises an AND gate 60 having a pair of inputs receiving the on-stoppage signal 16*d* and the car position signal 120-3 respectively and an output connected to the other inputs of the AND gate 40 and 50. An OR gate 62 has one input connected to the output of the memory 42, another input connected to the output of the AND gate 60, an and output connected to a resetting input of an S-R FLIP-FLOP 64 or a memory. Also, an OR gate 66 has one input receiving the designation switch signal 100-3 for the third floor, the other input connected to the output of the pulse generator 46 and an output connected to a setting input of the memory 64 which, in turn, produces the car call signal 14-3*a*.

Each of the second through sixth floors is operatively associated with an arrangement similar to that shown in FIG. 3.

The operation of the arrangements shown in FIGS. 1, 2 and 3 will now be described. It is now assumed that the elevator car lies on the first floor and the door thereof is in its open position. Under the assumed conditions, the car position signal 120-3 for the third floor is at its low level and therefore the output from the AND gate 60 is at its low level L. Also, assuming that the elevator car is operated in the normal mode, the memory 42 is reset to deliver the call registration inhibiting signal 42*a* put at its low level L to the OR gate 62. Thus, the output from the OR gate 62 is put at its low level L. Under these circumstances, when a passenger on the first floor gets into the elevator car and depresses the destination pushbutton for the third floor to register car call for the third floor, the resulting distination pushbutton signal 100-3 is put at its high level H and also the output from the OR gate 66 is put at a high level H to set the memory 64. Thus the car call signal 140-3*a* is also put at its high level H. Also, it is assumed that a car call for the fifth floor is similarly registered by another passenger and then the elevator car has departed from the first floor.

When the elevator car lands at the third floor in response to the car call for the third floor, the car position signal 120-3 is put at its high level H and the on-stoppage signal 16*d* is also put at its high level H. Thus, the AND gate 60 delivers an output at its high level H to put the output from the OR gate 62 at its high level H resulting in the resetting of the memory 64. As a result, the car call signal 14-3*a* is put at its low level L.

On the other hand, the command door closing signal 16*a* changes from its high level H to its low level L to put the output from the NOT gate 20*a* at its high level H (see FIG. 2). Since the car door is not yet opened, the door opening switch signal 16*b* is kept at its low level L and the output from the NOT gate 22*a* is at its high level H. Thus, the output from the AND gate 24*a* is put at its high level H. Thus, the timer 26*a* counts a time interval which has elapsed immediately after the issuance of the command door opening signal. When the car door has opened beyond the predetermined width, the door opening switch signal 16*b* is put at its high level H to put the output from the NOT gate 22*a* at its low level L. This causes the output from the AND gate 22*a* to be at its low level L and the output from the timer 26*a* is of a zero value.

Assuming that the door opening operation is normally completed in two seconds, the door opening disablement signal 10*a* and the abnormal door opening signal 10*a* which are the outputs from the comparators 28*a* and 30*a* respectively are maintained at their low level L. However, if the floor door on the third floor is in its abnormal state for some reason and prevented from opening up to the predetermined width, then the the abnormal door opening signal 10*b* from the comparator 30*a* is put at its high level H at a time point when four seconds have elapsed after the issuance of the command door opening signal. This causes the output from the AND gate 40 (see FIG. 3) to be put at its high level H. Thus, the memory 42 is set to change the call registration inhibiting signal 42*a* for the third floor therefrom to its high level H. Accordingly, resetting signals continue to enter the resetting input to the memory 64 through the OR gate 62 with the result that the car call for the third floor can not be registered in the call register circuit section 14-3B. This is true in the case of up and down floor calls on and for the third floor because those floor calls are registered by repeating the process similar to that described above.

Assuming that the door has been able to open beyond the predetermined width at the end of seven seconds reckoned from the issuance of the command door opening signal, the door opening disablement is not detected so that the door opening switch signal 16*b* is at its high level H to put the output from the NOT gate 22*a* at its low level L. Thus, the AND gate 24*a* has the output at its low level L and the timer 26*a* delivers an output of zero to the comparators 28*a* and 30*a*. Therefore, the outputs from the comparators 28*a* and 30*a* are put at their low level L. This means that the abnormal door opening signal 10*b* is put at its low level L. However, the call registration inhibiting signal 42*a* is maintained at its high level H because the memory 42 is in its set position.

It is assumed that, after its departure from the third floor, the elevator car has landed at the fifth floor in response to the car call therefor and the car door has normally opened on the fifth floor. After the passenger has left the elevator car and the car and floor doors have been closed, a car call and a floor call for another floor may be absent. In that case, the elevator car has no destination direction and is on standby with its door closed. At that time, the direction setting signal 16*f* is put at its low level L, the output from the NOT gate 58 is at its high level H, the on-stoppage signal 16*d* is at its high level H, the door closing switch signal 16*c* is at its high level H, and the output from the memory 54 is at its low level L because of its resetting. Also, the output from the NOT gate 56 and the call registration inhibiting signal 42*a* are put at their high level H. Thus, the output from the AND gate 44 is put at its high level H to set the memory 48. Accordingly, the no-re-operation signal 48*a* is put at its high level H. On the other hand, the pulse generator 46 is operated to produce th pulse signal 46*a* at its high level H. Thus, the memory 42 is reset to put the call registration inhibiting signal 42*a* at its low level L. At that time the output from the OR gate 62 is put at its low level L because the car position signal 120-3 is put at its low level L to put the output from the AND gate 60 at its low level L. Also, the output from the OR gate 66 is put at its high level H to set the memory 64. Thus, the car call signal 14-3*a* from the memory 64 for the third floor is put at its high level H. Accordingly, the elevator car is set to travel in the down direction and departs from the fifth toward the third floor.

Then, the elevator car reaches the third floor to be stopped thereon. At that time, the abovementioned car call signal 14-3*a* for the third floor is reset to its low level L. When the door opening operation is re-executed on the third floor, let it be assumed that the door re-opening is for a time interval of not less than four seconds. The assumed conditions are detected as an abnormality. Thus, the abnormal door opening signal 10*b* is put at its high level H to put the output from the AND gate 40 at its high level H to thereby again set the memory 42. Accordingly, the call registration inhibiting signal 42*a* is put at its high level H. Also, since the on-re-operation signal 48*a* remains at its high level H, the output from the AND gate 52 is put at its high level H to set the memory 54. Thus, the re-execution disablement signal 54*a* is put at its high level H to put the output from the NOT gate 56 at its low level L. Therefore, the output from the AND gate 44 is put at its low level L and the pulse generator 46 is disabled so as to not produce its output. Thus, the car call signal 14-3*a* for the third floor is not put at its high level H. This causes the door opening operation to be disabled. As a result, it is necessary for an operator to operate the resetting switch 130 (see FIG. 1) so as to put the resetting signal 16*e* at its high level H to reset the memory 54 after which the calls for the third floor can be registered.

On the other hand let it be assumed that when the door opening operation has been again executed, the door opens normally. Under the assumed conditions, the abnormal door opening signal 10*b* is at its low level L to let the memory 42 be reset. Thus, it is possible to register calls for the third floor. Thus passengers can be served. Also, since the door opening switch signal 16*b* is put at its high level H, the output from the AND gate 50 is put at its high level H to reset the memory 48 to put the on-re-operation signal 48*a* at its low level L resulting in the return-back to the normal mode of operation.

When the door control circuit 16 (see FIG. 1) has actually failed so as to disable the door opening operation, even though eight seconds have elaped after the issuance of the command door opening signal, the comparator 28*a* causes the door opening disablement signal 10*a* therefrom to be put at its high level H. Under these circumstances, the elevator car is caused to travel to the next succeding floor whether or not the door opening operation is detected as being disabled. Upon detecting the door opening disablement, the elevator car is put out of operation and the response to calls for the third floor are inhibited until the operator can completely remove the causes for which the door is disabled from opening. Regarding the measure as described above, reference may be made to the above-cited Japanese laid-open patent application No. 107,050/1978.

While the present invention has been described in conjunction with an disablement occurring in the door opening operation, it is to be understood that the same is equally applicable to a disablement in the departure operation, the door closing operation, etc.

Figure 4:
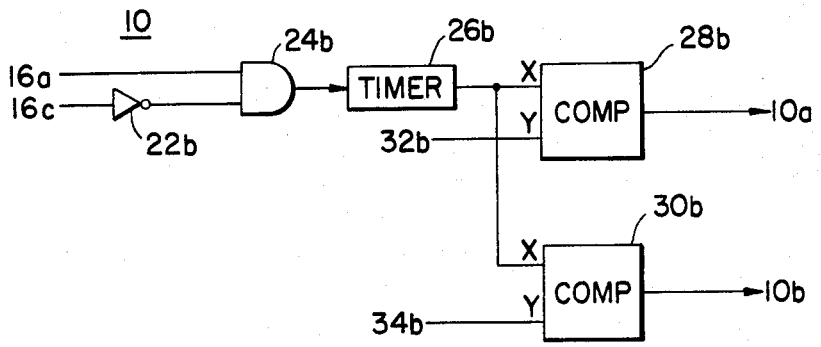
FIG. 4 is a diagram similar to FIG. 2 but illustrating a modification of the arrangement shown in FIG. 2.

In FIG. 4, wherein like or similar reference numerals designate the components identical to those shown in FIG. 2, e.g. timer 286 is similar to timer 28*a*, there is illustrated a modification of the arrangement illustrated in FIG. 2. The illustrated arrangement is different from that shown in FIG. 2 only in that in FIG. 4, a command door closing signal 16*a* is directly applied to the one input to the AND gate 24*b* with the NOT gate 20*a* omitted and a door closing switch signal 16*c* is substituted for the door opening switch signal 16*b*.

The arrangement is operatively associated with those arrangements shown in FIGS. 1 and 3 to detect the abnormal door closure in the manner similar to that described above in conjunction with FIG. 2. Thus, the comparators 28*b* and 30*b* produce a door closing disablement signal and an abnormal door closing signal also respectively designated by the reference numerals 10*a* and 10*b* respectively.

When the door closing disablement signal 10*a* is put at its high level H, the door control circuit 16 effects an emergency measure to repeat the door opening and closing operations as described, for example, in Japanese laid-open patent application No. 97,984/1979. The pertinent portion of the cited application is incorporated into the present specification by reference.

When an abnormality such as the abnormal door closure or the door closure disablement occurs on a floor, an emergency measure thereto is effected and the elevator car can depart from that floor after which calls for the floor are prevented from being registered. However, when the elevator car is empty, the same is returned back to the floor on which the abnormality has occurred and the door closure operation is re-executed. As a result, when the abnormal door enclosure or the door closure disablement is determined as resulting from a temporary cause such as a passenger causing mischief or a floor doorsill getting clogged by dust and so on, the elevator car is returned back to the normal mode of operation and the calls for the floor are again registered. This is true in the case of the arrangement shown in FIG. 2.

Figure 5:
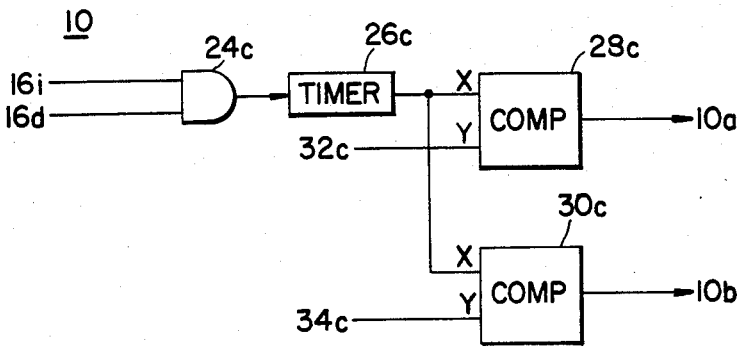
FIG. 5 is a diagram similar to FIG. 2 but illustrating another modification of the arrangement shown in FIG. 2.

In FIG. 5, wherein like or similar reference numerals designate the components identical to those shown in FIG. 2, there is illustrated another modification of the arrangement shown in FIG. 2 wherein an abnormal departure of the elevator car is detected. In the illustrated arrangement, the AND gate 24*c* receives the on-stoppage signal 16*d* and a command departure signal 16*i*. When a command departure is issued to put the command departure signal 16*i* at its high level H and the elevator car does not travel to put the on-stoppage signal 16*d* at its high level H, the comparator 30*c* is responsive to the output from the timer 26*c* which is greater in duration than the second constant magnitude signal 34*c* having a second reference duration, in this case, of 40 seconds, to detect the abnormal departure so as to deliver an abnormal departure signal at its high level H which signal is also designated by the reference numeral 10*b*. However, when the output from the timer 26*c* is larger in duration than the first constant signals 32*c* having a first reference duration, in this case, of 90 seconds, the comparator 28*c* detects a departure disablement to deliver a departure disablement signal at its high level H which is also designated by the reference numeral 10*a*. At that time, the elevator car is put out of operation.

While the present invention has been illustrated and described in conjunction with a few preferred embodiments thereof it is to be understood that numerous changes and modifications may be resorted to without departing from the spirit and scope of the present invention. For example, while the present invention has been arranged to be responsive to the repetition of similar abnormalities of the door opening operation during its re-execution so as to prevent an elevator car from being returned back to the normal mode of operation through further re-execution of the door opening operations, it is to be understood that the same is equally applicable to the re-execution thereof two times or more. Also, the re-execution may be effected with a time period of, for example, ten seconds. Furthermore, the re-execution is not restricted only to the elevator car being called to that floor on which the abnormality has been detected, but the re-execution may be effected with the elevator car on each of the floors.

Also, the present invention has been described in conjunction with the re-execution of that operation detected as being abnormal while the elevator car is left empty, but this measure results from the influences to passengers taken into consideration. For example, those influences involve a distrust felt by the passengers. If the re-execution less influences the passengers, then the operation detected as being abnormal may be re-executed with the elevator car having a passenger or passengers therein.

In addition, while the present invention has been illustrated and described in conjunction with a single elevator car serving a building, it is to be understood that the same is equally applicable to a plurality of elevator cars provided in a parallel relationship within a building.

What is claimed is:

1. An elevator operating system responsive to the detection of an abnormality of the operation of an elevator car to take an emergency measure which system comprises an elevator car, abnormality detector means for detecting an abnormality of said operation of said elevator car and generating a signal indicating the detected abnormality; and call register means for registering car calls due to destination pushbuttons disposed on said elevator car and floor calls due to floor pushbuttons and releasing the registration of said car and floor calls, said call register means including response limiting means responsive to said abnormality indicating signal from said abnormality detector means to limit the response to at least one of said car calls and said floor calls, re-execution means responsive to said elevator car put in a predetermined state to generate a command re-execution signal for re-executing the operation identical to that detected as including said abnormality, and releasing means for releasing the limitation of the response when said abnormality detector means does not detect the abnormality included in the operation performed with the command re-execution signal.

2. An elevator operating system as claimed in claim 1 wherein said abnormality detector means detects said abnormality of at least one of the door opening, door closing and departure operations of said elevator car to produce said abnormality indicating signal.

3. An elevator operating system as claimed in claim 2 wherein said abnormality detector means decides said abnormality in responsive to said one operation not quite performed or incompletely performed within a predetermined time interval.

4. An elevator operating system as claimed in claim 3 wherein said abnormality detector means includes a timer for counting a time interval for which said one operation is sufficiently performed to deliver a counted time interval and a comparator for comparing said counted time interval with a predetermined reference time interval and producing said abnormality indicating signal by deciding said abnormality upon confirming that said counted time interval is not shorter than said reference time interval.

5. An elevator operating system as claimed in claim 3 wherein said abnormality detector means has a pair of predetermined long and short reference time intervals and supplies said command re-execution signal to said call register mean when the same decides said abnormality on the basis of said short reference time interval.

6. An elevator operating system as claimed in claim 5 wherein when said abnormality detector means decides said abnormality on the basis of said long reference time interval, the same produces a signal for taking an emergency measure to travel said elevator car to the nearst floor and effect the door opening on said floor.

7. An elevator operating system as claimed in claim 5 wherein said abnormality detector means includes a timer for counting a time interval for which said one operation is sufficiently performed to generate a counted time interval, a first comparator for comparing said counted time interval with said long reference time interval to produce said abnormality indicating signal in response to said counted time interval not shorter than said long reference time interval, and a second comparator for comparing said counted time interval with said short reference time interval to produce said abnormality indicating signal in response to said counted time interval not shorter than said short reference time interval.

8. An elevator operating system as claimed in claim 5 wherein said long reference time interval is of eight seconds and said short reference time interval is of four second.

9. An elevator operating system as claimed in claim 1 wherein said response limiting means is responsive to said abnormality indicating signal to produce a signal for inhibiting the registration of calls concerning a floor on which said elevator car is located.

10. An elevator operating system as claimed in claim 1 wherein said response limiting means produces said response limiting signal by confirming that said abnormality indicating signal is produced during the landing and stoppage of said elevator car.

11. An elevator operating system as claimed in claim 1 wherein said response limiting means includes first memory means responsive to the issue of said abnormality indicating signal to store the presence of said abnormality.

12. An elevator operating system as claimed in claim 1 wherein when said elevator car is put out of service, said re-execution means produces a signal for registering a call for a floor on which said abnormality is detected and said response releasing means produces a signal for suspending the generation of said response limiting signal thereby to effect the re-execution.

13. An elevator operating system as claimed in claim 12 wherein when said abnormality of said operation of said elevator car is not detected during said re-execution, the released state due to said releasing signal from said releasing means is maintained intact to return back said elevator car to the normal mode of operation and when said abnormality is detected, said released state is removed to cause said response limiting means to again produce said limiting signal.

14. An elevator operating system as claimed in claim 1 wherein said re-execution means includes second memory means for storing the issue of said command re-execution signal, and said storing is erased when no abnormality is detected upon said re-execution.

15. An elevator operating system as claimed in claim 14 wherein said re-execution means includes third memory means for storing the issue of said abnormality indicating signal resulting from said abnormality detector means again detecting said abnormality during said re-execution and for producing a signal for inhibiting further re-execution.

16. An elevator operating system as claimed in claim 15 wherein said third memory means produces said re-execution inhibiting signal by confirming that said third memory means has said re-execution stored therein and that said abnormality detector means detects said abnormality.

17. An elevator operating system as claimed in claim 15 wherein said third memory means stores the detection of said abnormality during said re-execution, the re-execution inhibiting state is maintained until a manual operation is performed.

18. An elevator operating system as claimed in claim 1 wherein said re-execution means produces a re-execution signal by confirming that said abnormality indicating signal is produced, said elevator car is in its stopped state, a command destination signal is not applied to said elevator car and a car door is put in its closed position.

19. An elevator operating system as claimed in claim 1 wherein said releasing means includes a pulse generator responsive to said re-execution signal from said re-execution means to produces a pulse signal, and said pulse signal is operative to remove said response limiting signals from said response limiting means to cause calls for floors to be registered.

* * * * *